US006340425B2

(12) United States Patent
Ito

(10) Patent No.: US 6,340,425 B2
(45) **Date of Patent: *Jan. 22, 2002**

(54) METHOD OF MANUFACTURING COLD CATHODE DEVICE HAVING POROUS EMITTER

(75) Inventor: Fuminori Ito, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/544,476

(22) Filed: Apr. 7, 2000

(30) Foreign Application Priority Data

Apr. 8, 1999 (JP) ..... 11-101344

(51) Int. Cl.[7] ..... C25D 5/00; C25D 5/02; C25F 3/12

(52) U.S. Cl. ..... 205/655; 205/123; 205/91; 205/656; 205/655; 205/668

(58) Field of Search ..... 205/91, 123, 656, 205/668, 665, 655

(56) References Cited

U.S. PATENT DOCUMENTS

| | | | | |
|---|---|---|---|---|
| 5,568,288 A | * | 10/1996 | Yamazaki et al. | 205/125 X |
| 5,578,185 A | * | 11/1996 | Bergeron et al. | 205/123 |
| 5,755,944 A | * | 5/1998 | Haven et al. | 205/109 X |
| 5,863,233 A | * | 1/1999 | Porter et al. | 205/122 X |
| 5,944,975 A | * | 8/1999 | Wilson et al. | 205/122 |
| 6,139,716 A | * | 10/2000 | McCarthy et al. | 205/665 |

FOREIGN PATENT DOCUMENTS

| | | |
|---|---|---|
| JP | 08-87956 | 4/1996 |
| JP | 08-250766 | 9/1996 |
| JP | 09-237567 | 9/1997 |
| JP | 09-259795 | 10/1997 |

* cited by examiner

*Primary Examiner*—Donald R. Valentine
(74) *Attorney, Agent, or Firm*—Sughrue Mion, PLLC

(57) ABSTRACT

In the manufacturing of the cold cathode device which has a porous silicon portion as an emitter portion, the silicon layer is given an electric potential, while the gate electrode is given an electric potential lower than that of the silicon layer. And thereby, the predetermined portion of the silicon layer is subjected to anodic etching to be rendered into the porous silicon portion. With such anodic etching, the cold cathode device with the porous silicon portion is obtained.

12 Claims, 7 Drawing Sheets

METHOD OF MANUFACTURING COLD CATHODE DEVICE HAVING POROUS EMITTER

BACKGROUND OF THE INVENTION

This invention relates to a method of manufacturing a cold cathode device which has a porous portion, for example, a porous silicon portion, as an emitter portion. Such cold cathode can be fabricated in a flat display, a cathode ray tube (CRT), an electron microscope, an electron beam (EB) lithography apparatus, and EB sources for use in various kinds of EB apparatuses.

A field emission cold cathode is manufactured by using a technology of semiconductor minute processing. With the rapid development of the technology, the field emission cold cathode comes to have a high performance and might be expected to be substituted for a conventional cathode device.

Various kinds of proposals have been made about the cold cathode devices, in order to improve performance of the devices. One of them has a porous portion as an emitter portion. In such cold cathode, when a voltage is given between an emitter substrate having the emitter portion and a gate electrode of the cold cathode, the voltage generates an electrical field, which concentrates on the porous portion, because of high resistance of the porous portion. The concentrated field let the porous portions emit electrons, efficiently.

Such cold cathode devices with porous emitters are disclosed in, for example, JP-A Nos. 8-87956, 8-250766, 9-237567, and 9-259795, which will be referred to as conventional techniques. Furthermore, the conventional techniques also teach us various methods of manufacturing the cold cathode devices with porous emitters, in each of which anodic etching process is executed to render the silicon portion into the porous emitters.

However, these conventional techniques have a disadvantage that the conventional techniques can not always provide even quality of the emitter portions. In detail, n-type silicon is selected as a material of the emitter substrate in every conventional technique, because the n-type substrate can emit the electron without saturation. This n-type substrate should be subjected to irradiation during the anodic etching, in order to promote a reaction of the anodic etching. Good reaction makes the porous pretty fine. On the other hand, electron emission depends on thickness of the porous silicon and size of fine crystal comprising the porous silicon, and they are influenced by the irradiation. These means that the uniform electron emission can not be obtained, if the irradiation is not executed uniformly. In spite of this, the irradiation according to the conventional technique is not always uniformly executed, and makes the quality of the porous in the emitter portion uneven.

For example, JP-A 8-87956 uses two electrode plates only for anodic etching to form the porous emitter. The electrode plates are made of metal material, such as platinum (Pt), and have characteristics of blocking off light emitted from light source. As the results, the light source irradiates silicon portion from an inclined direction with respect to a gate electrode of the cold cathode device, in JP-A 8-87956. Such inclined irradiation brings about uneven quality into the emitter portion, because the silicon portion can not be subjected to a uniform irradiation.

There is an anodic etching technique known to the inventor that uses the emitter substrate instead of an anodic one of the foregoing electrode plates. Such technique also causes the above-mentioned inclined irradiation, resulting in bringing about the same problem. Furthermore, the other conventional techniques may employ either one of the foregoing anodic etchings and, in this event, can not prevent the uniform irradiation.

SUMMARY OF THE INVENTION

This invention therefore provide a method of manufacturing a cold cathode, in which an anodic etching is executed with a uniform irradiation for a predetermined silicon portion, and can obtain a desirable porous silicon portion.

According to one aspect of the present invention, a method for manufacturing a cold cathode device which has a porous silicon portion as an emitter portion, is obtained. Such method includes the following processes. First, an object that comprises a silicon layer, a gate electrode, and an insulator layer interposed between the silicon layer and the gate electrode, is formed. Herein, the gate electrode has a gate aperture, while the insulator layer has a through-hole corresponding to the gate aperture. The silicon layer has a predetermined portion exposed inside the through-hole.

And then, a part of the object is soaked into an electrolytic solution, so that both the through-hole and the gate aperture are filled with the electrolytic solution. Under the circumstances, the silicon layer is given an electric potential, while the gate electrode is given an electric potential lower than that of the silicon layer. And thereby, the predetermined portion is subjected to anodic etching to be rendered into the porous silicon portion. That is, in this anodic etching, the silicon layer serves as an anode electrode, while the gate electrode serves as a cathode electrode. Such anodic etching changes the object into the cold cathode device with the porous silicon portion.

The silicon layer may be made of n-type silicon. In this case, the above-mentioned method may further comprise irradiating the predetermined portion through both the through-hole and the gate aperture from a vertical direction with respect to the gate electrode, during the giving the electric potential to the silicon layer.

With such processes, the manufacturing method does not require an electrode plate only for anodic etching. In addition, the predetermined silicon portion is irradiated from the vertical direction with respect to the gate electrode, and therefore, the irradiation is executed uniformly for the predetermined silicon portion to change it into the desirable porous silicon portion.

DESCRIPTION OF THE PREFERRED EMBODIMENTS

Figure 1A:
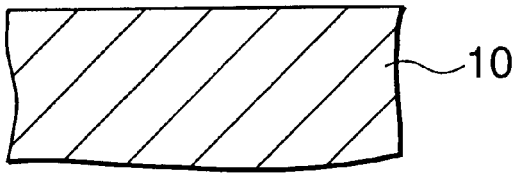
FIGS. 1A through 1E show sectional views for use in describing a manufacturing method according to one embodiment of the present invention.

Now, detail explanations will be made about a manufacturing method according to a preferred embodiment of this invention with reference to drawings.

In the method of this embodiment, an object is formed to comprise a silicon substrate 10, a gate electrode 20, and an insulator layer 30 interposed between the silicon substrate 10 and the gate electrode 20, as shown in FIGS. 1A through 1D. The gate electrode 20 has a gate aperture 21, while the insulator layer 30 has a through-hole 31 corresponding to the gate aperture 21. The silicon substrate 10 has a predetermined portion 11 exposed inside the through-hole 31.

In detail, the silicon substrate 10 is provided, as shown in FIG. 1A. The illustrated silicon substrate 10 is made of n-type silicon, which has single crystal. Materials, which come to have porous portions when the materials is subjected to the anodic etching, may be used instead of the silicon substrate 10. Such materials are, for example, a conductive material, such as aluminum (Al), and semiconductive materials, such as indium phosphide (InP), gallium arsenide (GaAs), silicon carbide (SiC), germanium (Ge), cadmium selenide (CdSe), and compound semiconductor thereof. Other semiconductor of families II–VI, III–V, and IV, may be used as the material of the substrate. Also, amorphous silicon and polycrystalline silicon may be used as the material.

Figure 1B:
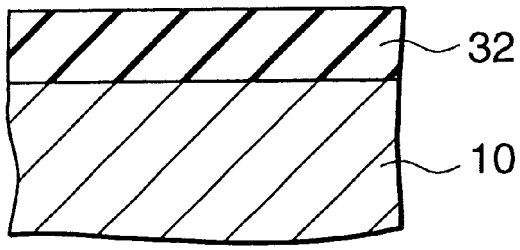

And then, a pre-processed insulator layer 32 is formed on the silicon substrate 10, as shown in FIG. 1B. The illustrated pre-processed insulator layer 32 is of nitride film and is 1 $\mu$m in depth. Such insulator layer 32 may be formed by heat treatment, chemical vapor deposition (CVD), and so forth. Insulator materials that have characteristics of acid-resistance for strong acid, such as a hydrofluoric acid (HF solution), can be used as the pre-processed insulator layer 32.

Figure 1C:
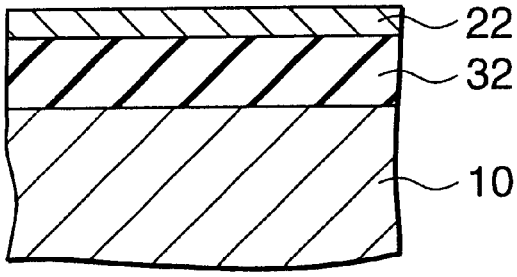
Figure 1D:
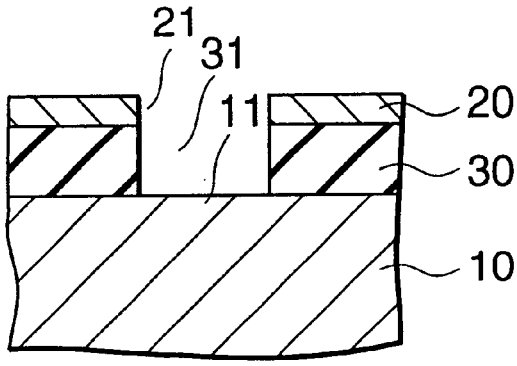

As shown in FIG. 1C, a pre-processed gate electrode 22 is formed on the pre-processed insulator layer 32. The illustrated pre-processed gate electrode 22 is of platinum (Pt) and is 0.5 $\mu$m in depth. Such gate electrode 22 may be made of materials which have characteristics of acid-resistance for strong acid, such as a gold (Au).

The pre-processed gate electrode 22 and the pre-processed insulator layer 32 are etched to form the gate aperture 21 and the through-hole 31. In this embodiment, the gate aperture 21 and the through-hole 31 are both square of 5 $\mu$m×5 $\mu$m. And thereby, the pre-processed gate electrode 22 and the pre-processed insulator layer 32 into the gate electrode 20 and the insulator layer 30. At this time, a predetermined portion 11 of the silicon substrate 10 comes to be exposed to the inside of the through-hole 31. That is, the predetermined portion 11 is plane shape in this embodiment.

Figure 1E:
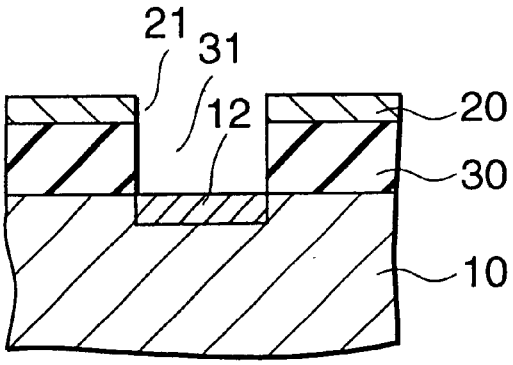

With the above-mentioned processes, the object is obtained. And then, the anodic etching is executed for the object under an electrolytic solution 40 to render the object into the cold cathode device, as shown in FIG. 1E.

In this embodiment, the electrolytic solution 40 is obtained by mixing hydrofluoric acid (HF solution) and water ($H_2O$) with a mixed ratio of 1:1. Such electrolytic solution 40 is kept within a container 50, that will be also referred to as a etching-tub.

Figure 2:
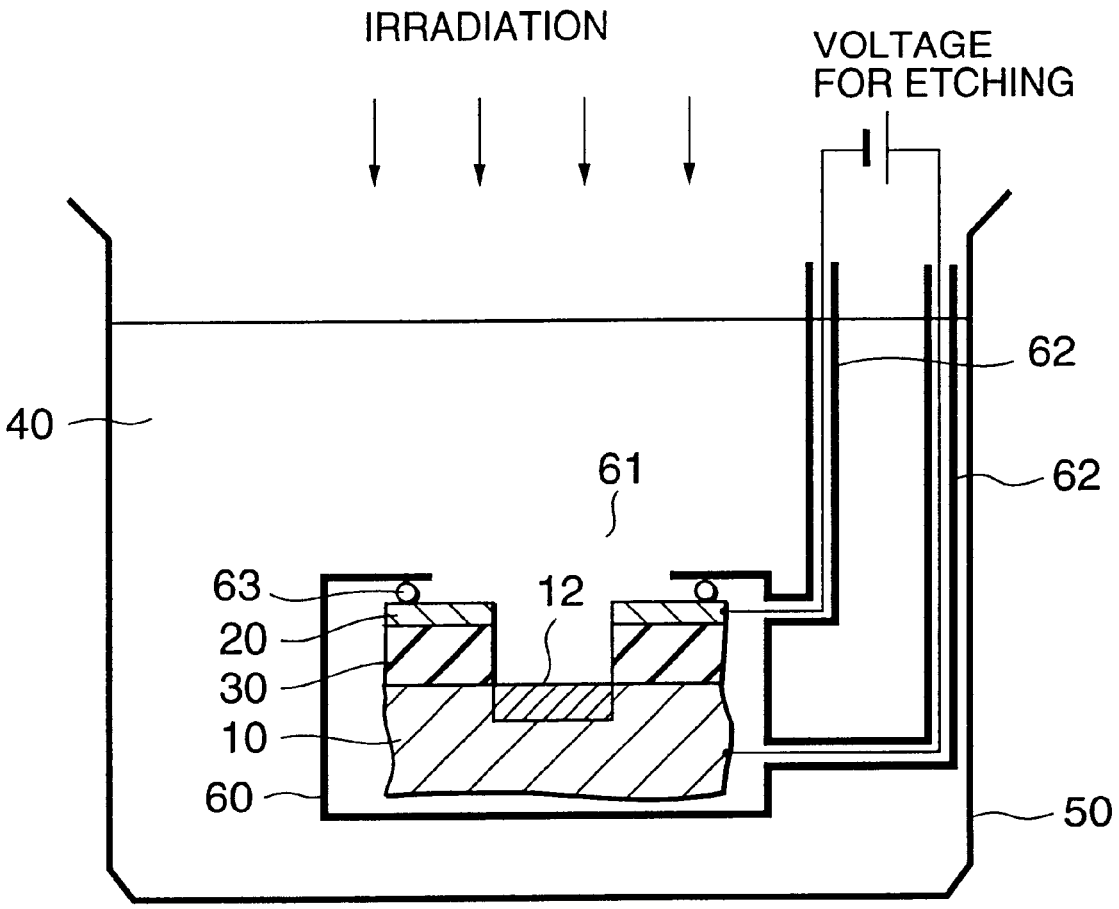
FIG. 2 shows a sectional view for use in describing an anodic etching process in the method illustrated in FIGS. 1A through 1E.

In order to soak only a part of the object into the electrolytic solution 40 in the anodic etching process, sealing member is attached prior to the anodic etching to the object. The sealing member comprising a receptacle 60 having an aperture 61, two tubes 62 connected to the receptacle 60, and an O-ring 63. The receptacle 60 is arranged to accommodate the object therein, with the gate electrode 20 facing to the aperture 61 of the receptacle 60, as shown in FIG. 2. The tubes 62 communicate between an inside of the receptacle 60 and an outside of the container 50, and guide, within the receptacle 60, conductive for use in the giving the electric potentials to the silicon substrate 10 and the gate electrode 20. The O-ring 63 is arranged between the gate electrode 20 and the receptacle 60. The O-ring 63 serves to fill up the gap between the gate electrode 20 and the receptacle 60.

All of them are made from a material, which has a sealing property when soaked into the electrolytic solution 40 and which does not substantially degrade when exposed to the solution 40. For example, polytetrafluoroethylene (PTFE) may be used as the material of the sealing members. AS the result, sealing member (60, 62 and 63) will seal the remaining part of the object from the electrolytic solution 40 when the object is soaked into the electrolytic solution 40.

Under the circumstances, the part of the object is soaked into the electrolytic solution 40 to fill both the gate aperture 21 and the through-hole 31 with the electrolytic solution 40. In the etching process illustrated in FIG. 2, since the gate electrode 20 and the insulator layer 30 are made of the material having properties of acid resistance, only the predetermined portion 11 of the silicon substrate 10 is subjected to etching, so as to be rendered into the porous silicon portion 12.

Generally, the predetermined portion of the silicon layer is subjected prior to the soaking to a natural oxidization, by being exposed to the atmosphere, and thereby, has a naturally oxidized portion. The naturally oxidized portion should be removed prior to the anodic etching. Therefore, the soaking is executed for a predetermined time interval that is required for removal of the naturally oxidized portion, before the giving the electric potentials to the silicon substrate and the gate electrode. The naturally oxidized portion dissolves in the electrolytic solution 40, and then, the surface of the silicon substrate 10 is subjected to the hydrogen termination. The removal of the naturally oxidized portion makes the silicon surface clean, and enables a uniform porous portion to be formed. In this embodiment, the predetermined time interval is two minutes.

After that, the silicon substrate 10 is given an electric potential, while the gate electrode 20 is given another potential lower than that of the silicon substrate 10. In this embodiment, the giving of the electric potentials causes a constant current for anodic etching, which has a current density of 50 mA/cm$^2$.

During the giving of the electric potentials, the predetermined portion 11 is irradiated through both the gate aperture 21 and the through-hole 31 from a vertical direction with respect to the gate electrode 20. In this embodiment, tungsten lamp having power of 100 W is used for the irradiation. Such anodic etching forms a porous silicon layer, 1 $\mu$m in thickness.

Figure 3:
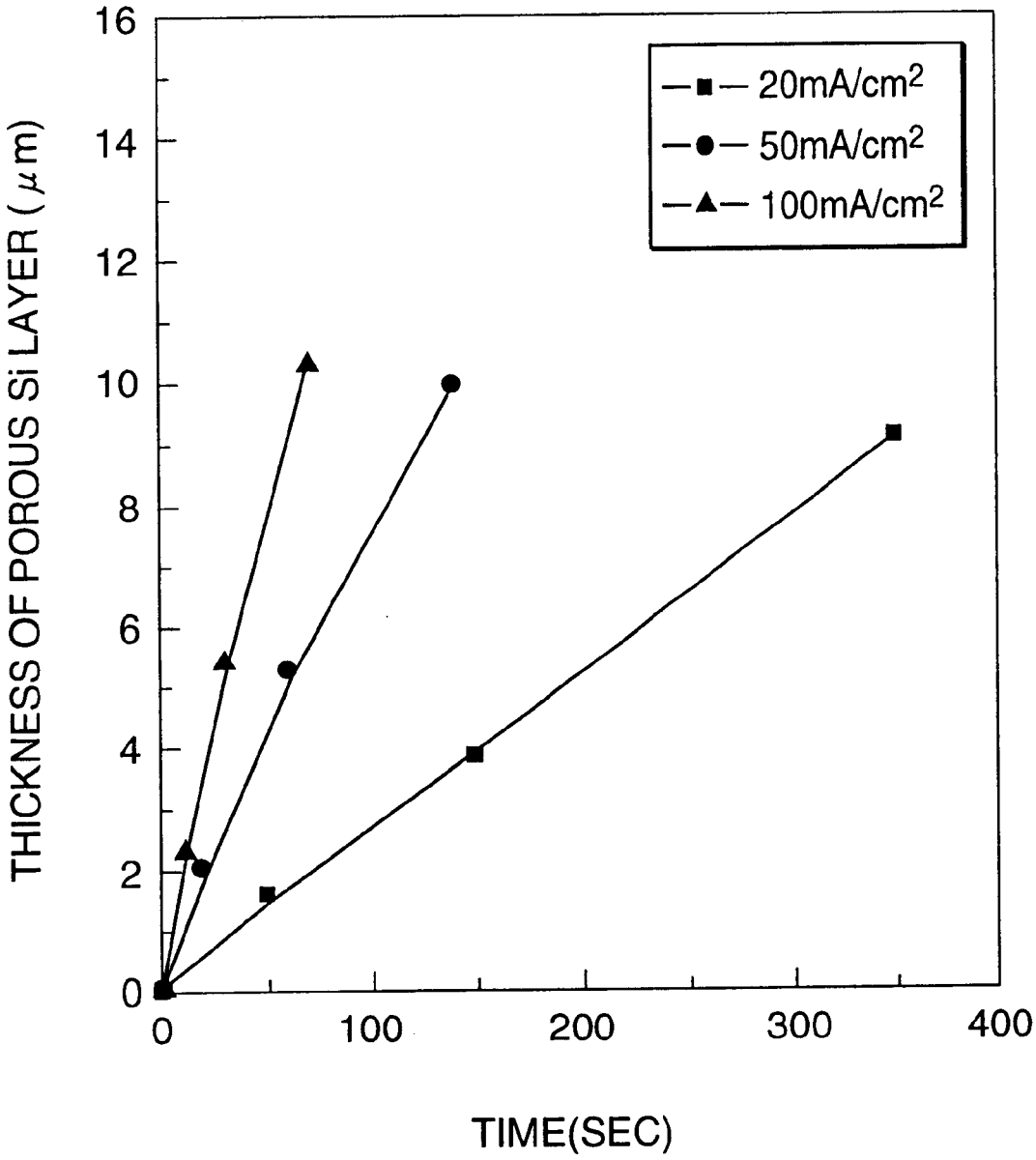
FIG. 3 shows a graph representing a relationship between irradiation time and thickness of porous silicon layer.

Referring to FIG. 3, a relationship between irradiation time and thickness of porous silicon layer, is represented. Generally, when the current for the anodic etching has the current density less than 300 mA/cm$^2$, the local elution of the silicon exposed to the electrolytic solution, such that the porous silicon portion is formed. The thickness of the porous silicon portion depends on the current density, concentration of HF acid in the electrolytic solution, time interval of the anodic etching, amount of the irradiation, the intensity of the light, and so on. In this embodiment, the concentration of HF acid is fixed, while the 100 W tungsten lamp is used for the irradiation, as mentioned above. In this case, the time interval and the current density influence on the thickness of the porous silicon layer, as shown in FIG. 3. This teaches us the fact that the higher current density and the longer time interval make the thickness of the porous silicon layer increase. In addition, this relationship locally stands on the predetermined portion of the silicon substrate, and therefore, the irradiation should be uniformly executed for the predetermined portion, in order to obtain a suitable porous silicon portion, as mentioned above.

With such method, the predetermined portion 11 of the silicon substrate 10 is uniformly subjected to anodic etching to be rendered into the porous silicon portion 12, and thereby, the object is changed into the cold cathode device having good property.

Figure 4:
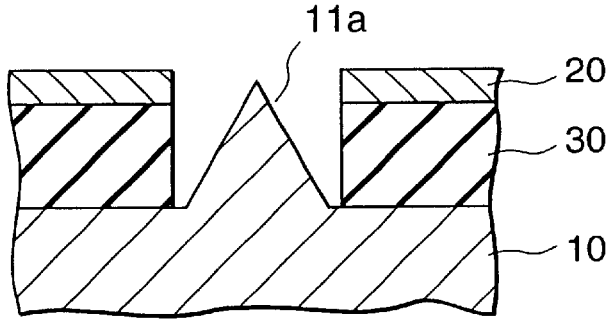
FIG. 4 shows another object, which can be applied with the anodic etching process shown in FIG. 2.
Figure 5:
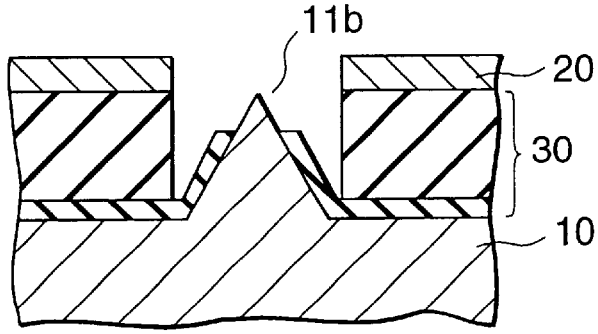
FIG. 5 shows another object, which can be applied with the anodic etching process shown in FIG. 2.
Figure 6:
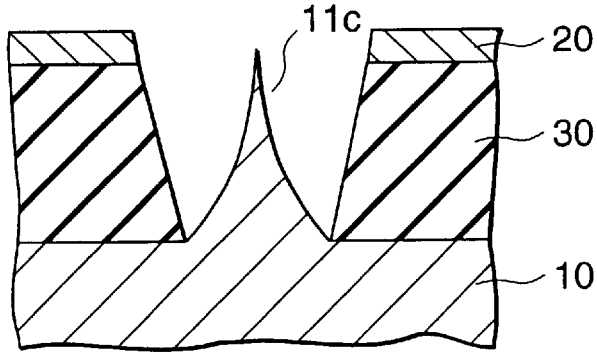
FIG. 6 shows another object, which can be applied with the anodic etching process shown in FIG. 2.
Figure 7:
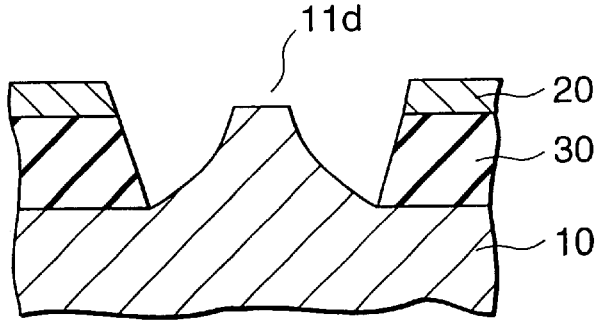
FIG. 7 shows another object, which can be applied with the anodic etching process shown in FIG. 2.

The above mentioned object comprises the predetermined portion 11 which is plane, and however, the shape does not restrict the present invention. For example, the object may comprise any one of the structures shown in FIGS. 4 through 7. The predetermined portion 11*a* illustrated in FIG. 4, has a conical shape, which is obtained by the under-etching process, and so on. The predetermined portion 11*b* illustrated in FIG. 5, has a conical shape, as a whole, and an exposed tip of the conical shape. Such structure is obtained by the process disclosed in the foregoing JP-A No. 9-237567, which is incorporated herein by reference. The predetermined portions 11*c* illustrated in FIG. 6, is so-called of Spindt type, which is obtained in the known manner with a release layer, and so forth. The predetermined portions 11*d* illustrated in FIG. 7, has a conical-mesa shape. Such structure is obtained by the process disclosed in the foregoing JP-A No. 8-87956, which is incorporated herein by reference. The object may comprise the predetermined portion of other shape, such as cylindrical shape, prism shape, or the like.

Figure 8:
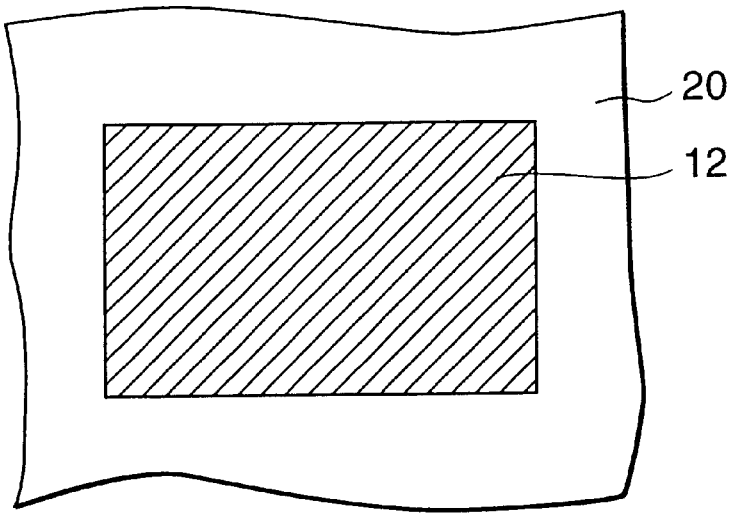
FIG. 8 shows a plane view of the cold cathode device obtained by the manufacturing method shown in FIGS. 1A through 1E.
Figure 9:
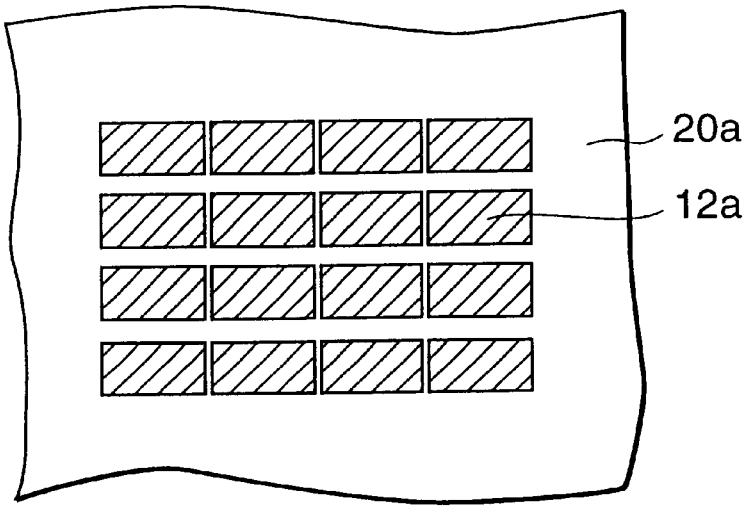
FIG. 9 shows a plane view for use in describing a modification of the manufacturing method shown in FIGS. 1A through 1E.
Figure 10:
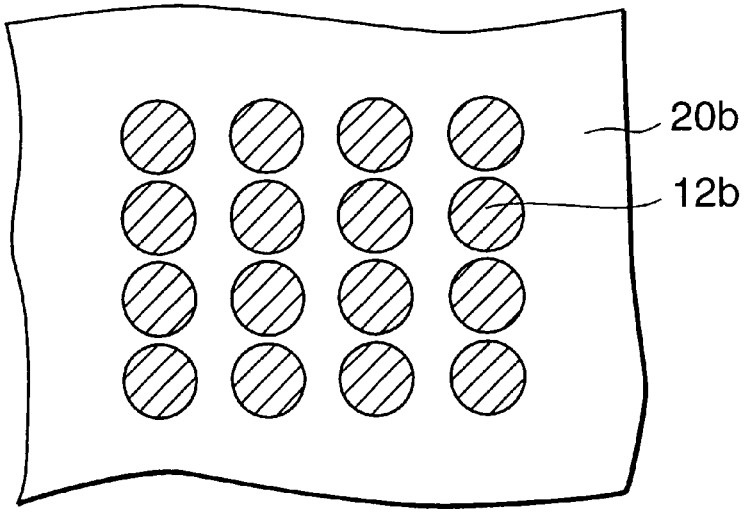
FIG. 10 shows a plane view for use in describing another modification of the manufacturing method shown in FIGS. 1A through 1E.

Now, explanations will be made about modifications of the foregoing embodiment, with further reference to FIGS. 8 through 10. FIG. 8 shows a plane view of the cold cathode device according to the foregoing embodiment, while FIGS. 9 and 10 show plane views of the modifications explained in later.

The modifications relate to the cold cathode devices for use in a display having a plurality of pixels. Compared FIGS. 9 and 10 with FIG. 8, the object of the modifications have, at each pixel, the silicon substrates (not shown), the gate electrodes 20*a* and 20*b*, and the insulator layers (not shown). The gate electrode 20*a* illustrated in FIG. 9, has a plurality of the gate apertures, while the corresponding insulator layer has a plurality of the through-holes. Accordingly, the object illustrated in FIG. 9, comprises a plurality of the porous silicon portions 12*a* of rectangular shape. Similarly, the object illustrated in FIG. 10, comprises a plurality of the porous silicon portions 12*b* of circular shape. That is, the gate aperture 12 of FIG. 8 is divided into the plurality of the gate apertures in FIGS. 9 and 10.

With such structures, thickness of the porous silicon portion is controlled to be uniform considerably, even if the emitter area becomes large. In the anodic etching process, if the emitter area is too large, thickness of the porous silicon portion does not become uniform. This is because the intensity of the current for anodic etching is large at areas closer to the gate electrode. As the result, the center of the emitter area has thin porous silicon, in comparison with that of the area closer to the gate electrode. On the contrary, the above structures illustrated in FIGS. 9 and 10, has the plurality of the gate apertures, each of which is smaller than the gate aperture shown in FIG. 8. Therefore, the modifications make the intensity of the current for anodic etching uniform, so that the cold cathode devices come to desirable characteristics.

The modified structures bring about still more effect which is an increase of the electron emission, because of the same principle in case where the uniform thickness of the porous silicon layer is obtained. That is, the structures shown in FIGS. 9 and 10 has the plurality of the gate apertures, each of which is smaller than the gate aperture shown in FIG. 8. Therefore, the modifications make the intensity of the electric field for electron emission uniform, so that the cold cathode devices achieve high efficiency of the emission. It is however noted that the substantial emitter area decrease in size, if parts of the gate electrode, which divides the original gate aperture into the plurality of the gate apertures, become large in size. Therefore, it is preferable that the modified structures have small-sized parts for dividing the original gate aperture.

The above-mentioned methods can be also applied to cold cathode devices which have silicon layers made of amorphous silicon and polycrystalline silicon. Such cold cathode devices are manufactured by the methods including the following processes. When a glass substrate is provided, a metal layer is formed on the glass substrate. Instead of the glass substrate, substrates made of $Al_2O_3$, BN, and $Si_3N_4$ may be used. And then, a polycrystalline silicon layer is formed as the silicon layer on the metal layer. And then, a pre-processed insulator layer is formed on the silicon layer, and a pre-processed gate electrode is formed on the preprocessed insulator layer. After that the pre-processed gate electrode and the pre-processed insulator layer are etched to form the gate aperture and the through-hole, and thereby, the object is obtained. The object is rendered into the cold cathode devices by the anodic etching according to the present invention.

Figure 11:
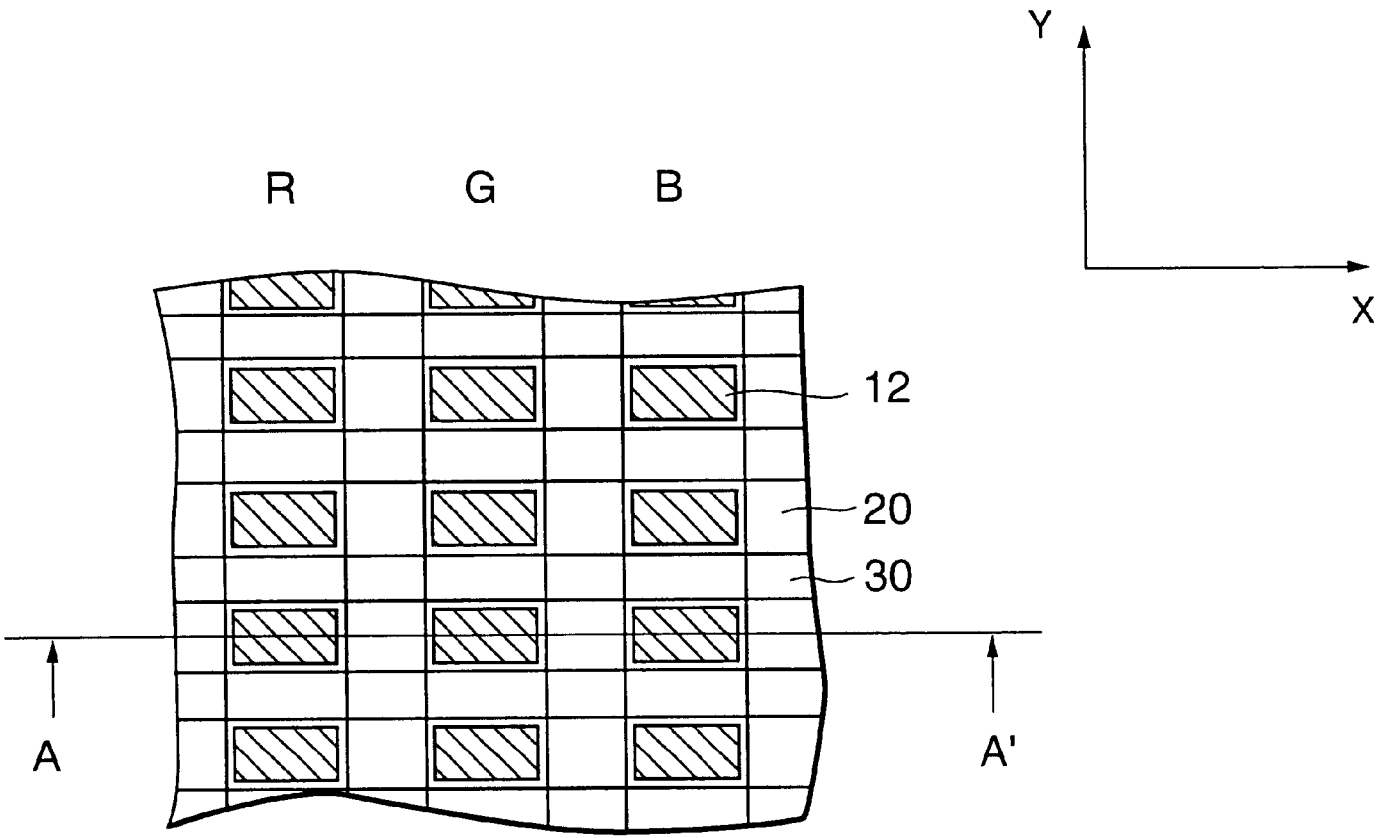
FIG. 11 shows a plane view of the flat display obtained by utilizing another modification of the manufacturing method shown in FIGS. 1A through 1E.

Now, description will be further made about an application where the foregoing embodiment is applied to a flat display, with further reference to FIGS. 11 and 12.

Referring to FIG. 11, the flat display comprises the cold cathode device having a plurality of pixels each of which corresponds to any one of red (R), green (G), and blue (B), and which are arranged in a matrix fashion. In detail, the cold cathode device comprises a glass substrate 70, a plurality of lower electrodes 80, a plurality of silicon layers 10*a*, insulator layer 30, and a plurality of the gate electrodes 20, as shown in FIGS. 11 and 12E. Herein, the lower electrodes 80 and the silicon layers 10*a* are stripe films and extend in Y-direction. On the other hand, the gate electrodes 20 are also stripe films and extend in X-direction. Such cold cathode device is manufactured by the following processes.

Figure 12A:
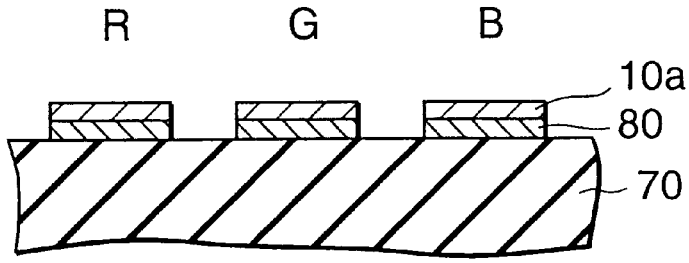
FIGS. 12A through 12E show sectional views taken substantially along the lines A–A' of FIG. 11.

When the glass substrate 70 is provided, a plurality of metal stripe films are formed as the plurality of the lower electrodes 80 on the glass substrate 70, as shown in FIG. 12A. The plurality of metal stripe films which extend in the Y-direction and are parallel to one another, so that the glass substrate 70 has exposed areas between the metal stripe films as the lower electrodes 80. The illustrated metal stripe films are 0.5 μm in thickness.

And then, the plurality of the silicon layers 10*a* are formed on the plurality of metal stripe films 80. In this embodiment, the silicon layers 10*a* are made of polycrystalline silicon and are 1.5 μm in thickness.

Figure 12B:
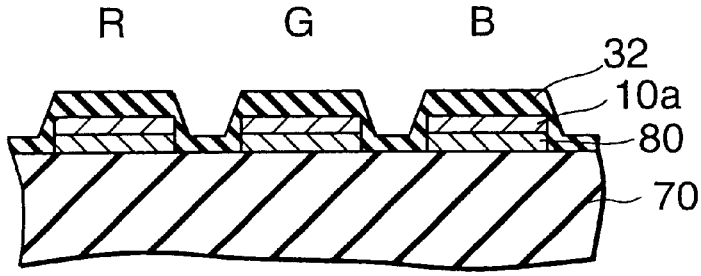
Figure 12C:
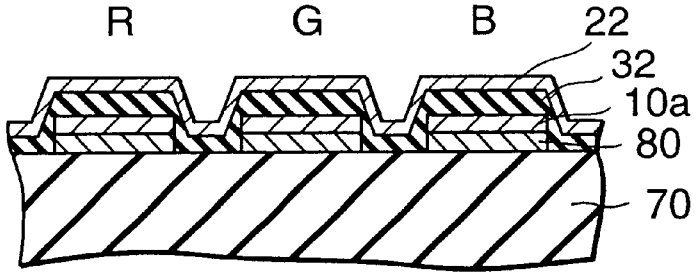

And then, the pre-processed insulator layer 32 is formed on the plurality of silicon layers 10*a* and the exposed areas of the glass substrate 70, as shown in FIG. 12B. In this embodiment, the insulator layer 32 is made of nitride film, 1 μm in thickness. Conductive stripe films 22 are formed, as the plurality of pre-processed gate electrodes, on the pre-processed insulator layer 32, as shown in FIG. 12C. The conductive stripe films 22 extend in the X-direction and are parallel to each other. In this embodiment, the conductive stripe films 22 are 0.5 μm in thickness.

Figure 12D:
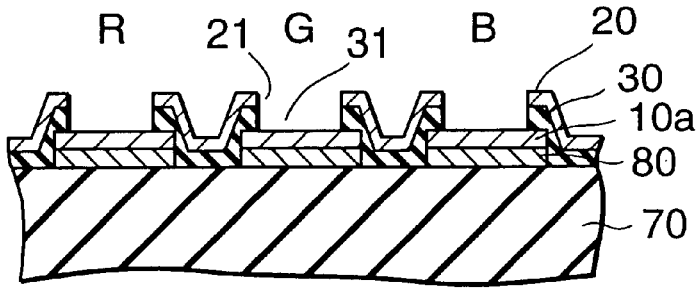
Figure 12E:
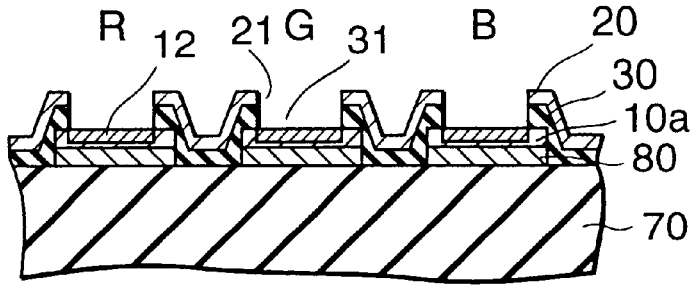

After that, the conductive stripe films 22 and the pre-processed insulator layer 32 are etched at cross points of the conductive stripe films 22 and the metal stripe films 80, to form the gate apertures and the through-holes of the pixels. And thereby, the conductive stripe films 22 and the pre-processed insulator layer 32 are transformed into the gate electrodes 20 and the insulator layers 30 of the pixels, so that the object is obtained, as shown in FIG. 12D.

When the object is subjected to the anodic etching according to the present invention, the cold cathode devices is obtained, as shown in FIG. 12E.

While this invention has thus far been described in conjunction with the preferred embodiment thereof, it will now be readily possible for skilled persons in the art to put this preferred embodiment into various other manners. With respect to the irradiation, lens system may be used together with the light source. Such employment is effective to increase of directivity and uniformity of the irradiation. The substrate may be rotated during the anodic etching, in order to increase of the uniformity of the irradiation.

What is claimed is:

1. A method for manufacturing a cold cathode device which has a porous silicon portion as an emitter portion, the method including:

forming an object that comprises a silicon layer, a gate electrode, and an insulator layer interposed between the silicon layer and the gate electrode, the gate electrode having a gate aperture, the insulator layer having a through-hole corresponding to the gate aperture, the silicon layer having a predetermined portion exposed inside the through-hole;

soaking a part of the object into an electrolytic solution to fill both the through-hole and the gate aperture with the electrolytic solution; and giving the silicon layer an electric potential, while giving the gate electrode another potential lower than that of the silicon layer, so that the predetermined portion is subjected to anodic etching to be rendered into the porous silicon portion, and thereby, the object is changed into the cold cathode device.

2. A manufacturing method as claimed in claim 1, wherein the silicon layer is made of n-type silicon.

3. A manufacturing method as claimed in claim 2, further comprising irradiating the predetermined portion through both the through-hole and the gate aperture from a vertical direction with respect to the gate electrode, during the giving the electric potential to the silicon layer.

4. A manufacturing method as claimed in claim 1, wherein:

the predetermined portion of the silicon layer is subjected prior to the soaking to a natural oxidization, and thereby, has a naturally oxidized portion;

the soaking being executed for a predetermined time interval which is required for removal of the naturally oxidized portion, and then, the giving the electric potential to the silicon layer being executed.

5. A manufacturing method as claimed in claim 1, further comprising, after the forming and prior to the soaking: providing sealing member, and sealing the remaining part of the object from the electrolytic solution by sealing member.

6. A manufacturing method as claimed in claim 5, wherein:

the electrolytic solution is kept within a container;

the sealing member comprising a receptacle having an aperture, two tubes connected to the receptacle, and an O-ring;

the receptacle being adapted to accommodate the object therein, with the gate electrode facing to the aperture of the receptacle;

the O-ring being arranged between the gate electrode and the receptacle and being adapted to seal the remaining part of the object from the electrolytic solution;

the tubes communicating between an inside of the receptacle and an outside of the container, and being adapted to guide, within the receptacle, conductive for use in the giving the electric potential to the silicon layer.

7. A manufacturing method as claimed in claim 1, wherein the forming comprises:

forming a pre-processed insulator layer on the silicon layer;

forming a pre-processed gate electrode on the pre-processed insulator layer;

etching the pre-processed gate electrode and the pre-processed insulator layer to form the gate aperture and the through-hole, and thereby, transforming the pre-processed gate electrode and the pre-processed insulator layer into the gate electrode and the insulator layer.

8. A manufacturing method as claimed in claim 1, wherein the forming comprises:

forming a metal layer on a glass substrate;

forming a polycrystalline silicon layer as the silicon layer on the metal layer;

forming a pre-processed insulator layer on the silicon layer;

forming a pre-processed gate electrode on the pre-processed insulator layer;

etching the pre-processed gate electrode and the pre-processed insulator layer to form the gate aperture and the through-hole, and thereby, transforming the pre-processed gate electrode and the pre-processed insulator layer into the gate electrode and the insulator layer.

9. A manufacturing method as claimed in claim 1, wherein: the cold cathode device is for use in a flat display having a plurality of pixels; the object having the silicon layer, the gate electrode, and the insulator layer at each of pixels.

10. A manufacturing method as claimed in claim 9, wherein the forming comprises:

forming, on a glass substrate, a plurality of metal stripe films which extend in a first direction and are parallel to one another, so that the glass substrate has exposed areas between the metal stripe films;

forming, on the plurality of metal stripe films, a plurality of polycrystalline silicon layers serving as the silicon layers of the pixels;

forming a pre-processed insulator layer on the plurality of polycrystalline silicon layers and the exposed areas of the glass substrate;

forming, on the pre-processed insulator layer, conductive stripe films which extend in a second direction perpendicular to the first direction and parallel to each other;

etching the conductive stripe films and the pre-processed insulator layer at cross points of the conductive stripe films and the metal stripe films, to form the gate apertures and the through-holes of the pixels, and thereby, transforming conductive stripe films and the pre-processed insulator layer into the gate electrodes and the insulator layers of the pixels.

11. A manufacturing method as claimed in claim 1 wherein: the cold cathode device is for use in a display having a plurality of pixels; the object having the silicon layer, the gate electrode, and the insulator layer at each of pixels; the gate electrode and the insulator layer having a plurality of the gate apertures and a plurality of the through-holes at each of pixels.

12. A method for manufacturing a cold cathode device which has a porous emitter portion, the method including:

forming an object that comprises a substrate, a gate electrode, and an insulator layer interposed between the substrate and the gate electrode, the gate electrode having a gate aperture, the insulator layer having a through-hole corresponding to the gate aperture, the substrate being made of one material selected from a group consisting of conductive and semiconductive materials and having a predetermined portion exposed inside the through-hole;

soaking a part of the object into an electrolytic solution to fill the through-hole and the gate aperture with the electrolytic solution; and rendering the object into the device by giving the substrate and the gate electrode an electric potential and another potential lower than that of the substrate, respectively, so that the predetermined portion is subjected to anodic etching to be the porous emitter portion.

* * * * *